US007585264B1

(12) United States Patent
Wang et al.

(10) Patent No.: US 7,585,264 B1
(45) Date of Patent: Sep. 8, 2009

(54) ADJUSTABLE TILTING INVERSION EXERCISER

(76) Inventors: Lopin Wang, 16F-2, No. 62, Sec. 2, Chonder 2nd Road, Beitun Chu, Taichung (TW) 40652; Roger C. Teeter, 20720 Snag Island Dr., Sumner, WA (US) 98390

( * ) Notice: Subject to any disclaimer, the term of this patent is extended or adjusted under 35 U.S.C. 154(b) by 0 days.

(21) Appl. No.: 12/384,517

(22) Filed: Apr. 6, 2009

Related U.S. Application Data

(63) Continuation-in-part of application No. 12/290,301, filed on Oct. 29, 2008.

(51) Int. Cl.
*A63B 26/00* (2006.01)

(52) U.S. Cl. ..... 482/144; 601/23

(58) Field of Classification Search ..... 482/143–145; 601/1, 23–26; 128/845
See application file for complete search history.

(56) References Cited

U.S. PATENT DOCUMENTS

| | | | | |
|---|---|---|---|---|
| 5,967,956 | A | 10/1999 | Teeter | 482/144 |
| 6,814,691 | B1 | 11/2004 | Kuo | 482/145 |
| 7,112,167 | B2 | 9/2006 | Kim | 482/145 |
| 7,125,372 | B1 | 10/2006 | Teeter et al. | 482/144 |

*Primary Examiner*—Lori Amerson
(74) *Attorney, Agent, or Firm*—Charles E. Baxley

(57) ABSTRACT

A tilting inversion exerciser includes a carrier having two arms pivotally attached to a supporting stand, a frame having a rod adjustably secured to the arms, a user supporting table attached to the frame, and a latching device releasably securing the rod of the frame to the arms for adjustably securing the user supporting table to the carrier and for adjusting a center of gravity of the user supporting table relative to the carrier and the supporting stand, and for suitably or adjustably supporting the users of different weights or body forms or physiques. The latching device includes a fastener for solidly securing the frame to the arms, and a latch member for adjustably securing the frame to the arms of the carrier.

8 Claims, 11 Drawing Sheets

ADJUSTABLE TILTING INVERSION EXERCISER

The present invention is a continuation-in-part of U.S. patent application Ser. No. 12/290,301, filed 29 Oct. 2008, pending and allowed.

BACKGROUND OF THE INVENTION

1. Field of the Invention

The present invention relates to a tilting inversion exerciser, and more particularly to an adjustable tilting inversion exerciser having a user supporting table pivotally or rotatably attached to a supporting stand with a pivot axle and movable or adjustable relative to the pivot axle of the supporting stand for suitably or adjustably supporting the users of different weights or body forms or physiques.

2. Description of the Prior Art

Typical tilting inversion exercisers comprise a base or table pivotally or rotatably supported on a lower support stand, for supporting a user thereon, and for allowing the user to tilt or to incline the table relative to the lower support, in order to conduct the typical tilting inversion exercises.

For example, U.S. Pat. No. 5,967,956 to Teeter discloses one of the typical rotatable or tilting inversion exercisers comprising a stationary support stand composed of spaced A-frames having spaced trunnion supporting bearing plates and hanger bars for supporting a user supporting table and for allowing the user supporting table to be pivoted or rotated relative to the stationary support stand.

However, the coupling mechanism between the user supporting table and the hanger bars is weak and may not be used to stably support the user on the user supporting table, or the user supporting table may have a good chance to be twisted relative to the hanger bars of the stationary support stand particularly when the user supporting table supports the users of greater weights or body forms or physiques.

U.S. Pat. No. 6,814,691 to Kuo discloses another typical rotatable or tilting inversion exerciser also comprising a user supporting table pivotally or rotatably attached or secured to the stationary support stand with hanger bars.

However, similarly, the coupling mechanism between the user supporting table and the hanger bars is weak and may not stably support the user on the user supporting table, or the user supporting table may have a good chance to be twisted relative to the hanger bars of the stationary support stand particularly when the user supporting table supports the users of greater weights or body forms or physiques.

U.S. Pat. No. 7,112,167 to Kim discloses a further typical rotatable or tilting inversion exerciser comprising a user supporting table pivotally or rotatably attached or secured to a stationary support stand, and one or more motors attached to the stationary support stand and coupled to the user supporting table for driving or rotating or tilting the user supporting table relative to the lower support stand.

However, the user supporting table may not be adjusted relative to the lower support stand to different positions for suitably or adjustably supporting the users of different weights or body forms or physiques.

U.S. Pat. No. 7,125,372 to Teeter et al. discloses a still further typical electric exerciser machine for tilting and inverting human body also comprising a rotatable frame pivotally or rotatably attached to top and supported on a lower support member with a pivoting tube, and a driving device mounted on the support member and having an electric motor for driving or rotating or tilting the rotatable frame relative to the lower support member.

However, similarly, the rotatable frame also may not be adjusted relative to the lower support member to different positions for suitably or adjustably supporting the users of different weights or body forms or physiques.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including a user supporting table pivotally or rotatably attached to a supporting stand with a pivot axle and movable or adjustable relative to the pivot axle of the supporting stand for suitably or adjustably supporting the users of different weights or body forms or physiques.

In accordance with one aspect of the invention, there is provided a tilting inversion exerciser comprising a supporting stand including two apex members, a carrier including two arms each having a first end pivotally attached to the apex member and each having a second end, and a bar attached to the second ends of the arms for forming a space between the arms and the bar, a frame slidably received in the space of the carrier and including a rod adjustably secured to the arms of the carrier for adjusting the frame toward and away from the bar of the carrier, a user supporting table attached to the frame for supporting a user thereon, and a latching device releasably securing the rod of the frame to the arms of the carrier for solidly and adjustably securing the user supporting table to the carrier and for suitably adjusting the center of gravity of the user supporting table and the user relative to the carrier and the supporting stand.

The frame includes two sleeve attached to two ends of the rod, and the sleeves each include a bore formed therein for slidably and adjustably receiving and engaging with the arms and for adjustably attaching or securing the rod of the frame to the arms of the carrier respectively.

Two bushings are engaged into the sleeves and engaged between the sleeves and the arms respectively. The latching device includes a fastener attached to each sleeve for engaging with the arms and for adjustably securing the sleeves of the frame to the arms.

The arms each include a plurality of orifices formed therein, and the fastener includes an anchoring end for engaging with either of the orifices of the arms and for adjustably securing the rod of the frame to the arms of the carrier.

Two latch members are slidably attached to the sleeves respectively and each include an actuating end for engaging with either of the orifices of the arms and for adjustably securing the rod of the frame to the arms of the carrier.

Two levers are pivotally attached to the sleeves respectively and each include an end pivotally coupled to the latch member. Two spring members are engaged with the sleeves and the levers respectively for biasing and forcing the actuating end of the latch member to engage with either of the orifices of the arms. The levers each include a middle portion pivotally attached to the sleeve with a pivot axle.

The latch members each include a peripheral stop for engaging with the sleeve and for limiting the latch member to slide relative to the sleeve and the carrier. The carrier includes two tubular members attached to two ends of the bar for slidably or adjustably receiving the arms and for solidly securing to the arms with at least one fastener.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
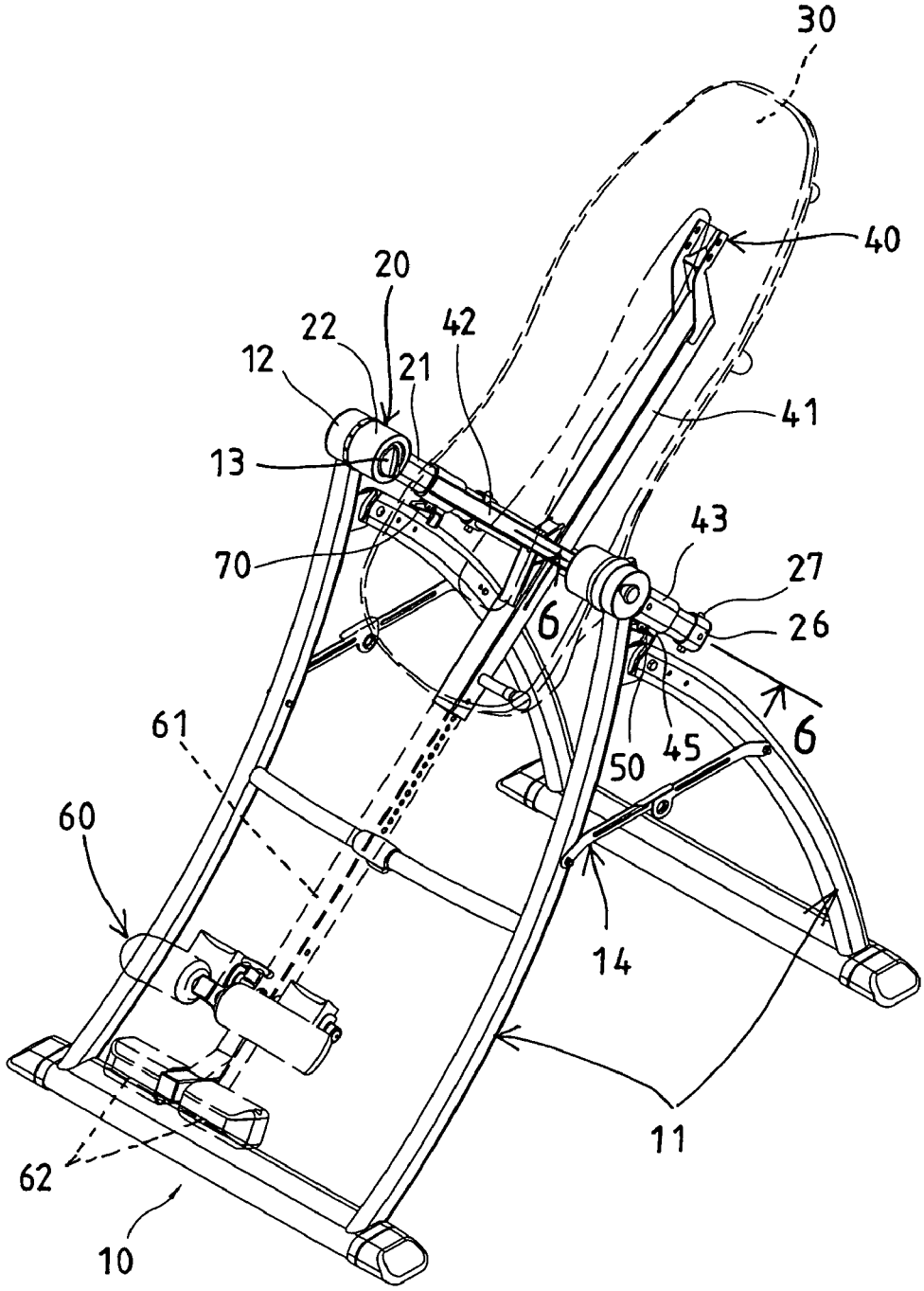
FIG. 1 is a perspective view of a tilting inversion exerciser in accordance with the present invention.
Figure 2:
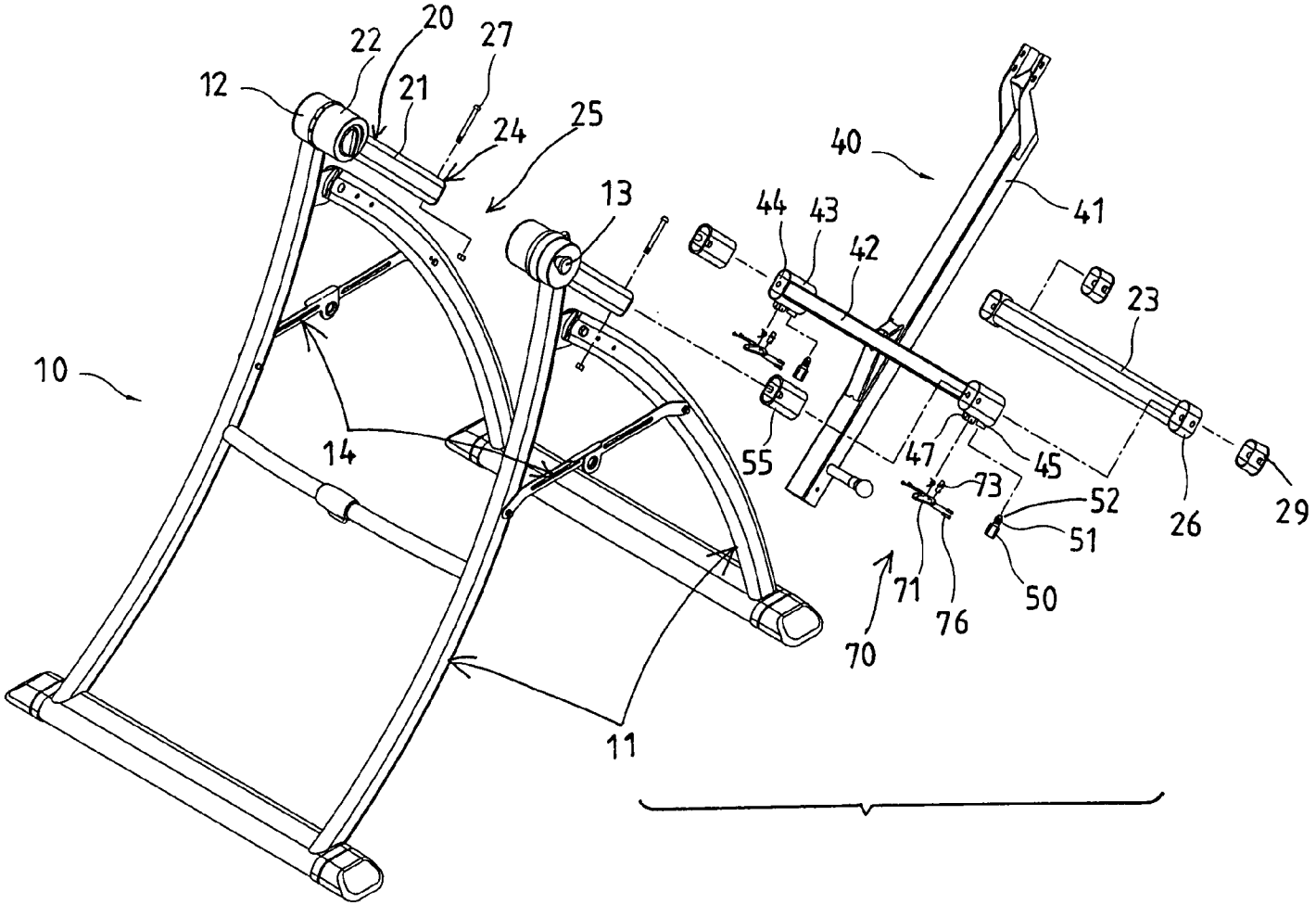
FIG. 2 is a partial exploded view of the tilting inversion exerciser.

Referring to the drawings, and initially to FIGS. 1 and 2, a tilting inversion exerciser in accordance with the present invention comprises a lower supporting stand 10 for pivotally or rotatably supporting a user supporting base or table 30 thereon, and then for supporting a user 8 on the user supporting table 30, the lower supporting stand 10 includes such as two U-shaped stand members 11 having upper ends pivotally coupled together with two apex members 12 so as to form a substantially inverted V-shaped and foldable structure. The lower supporting stand 10 includes a bearing support or pivot axle 13 disposed or attached to each of the apex members 12 for pivotally or rotatably supporting or coupling the user supporting table 30.

Figure 4:
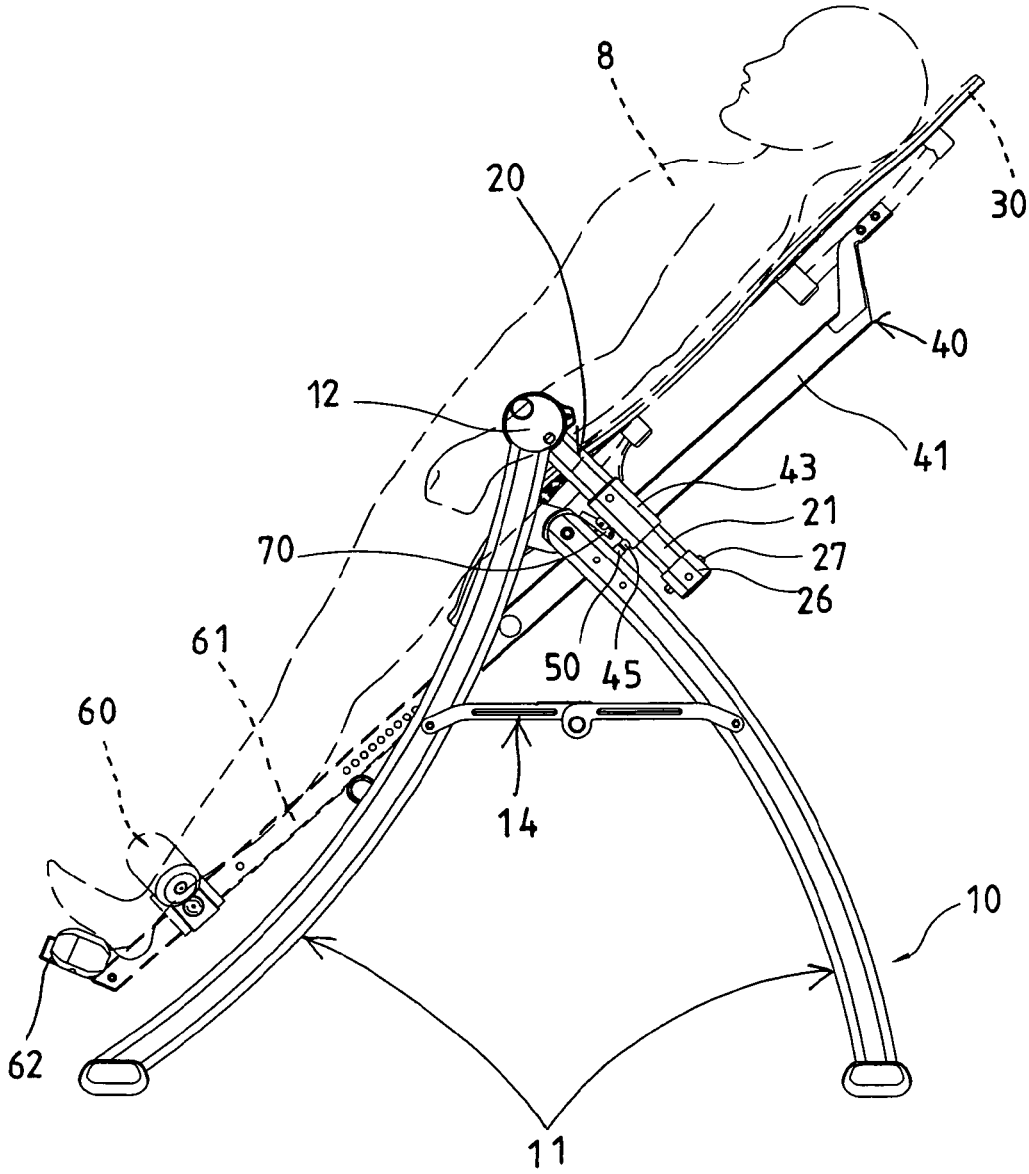
FIG. 4 is a side plan schematic view of the tilting inversion exerciser.
Figure 5:
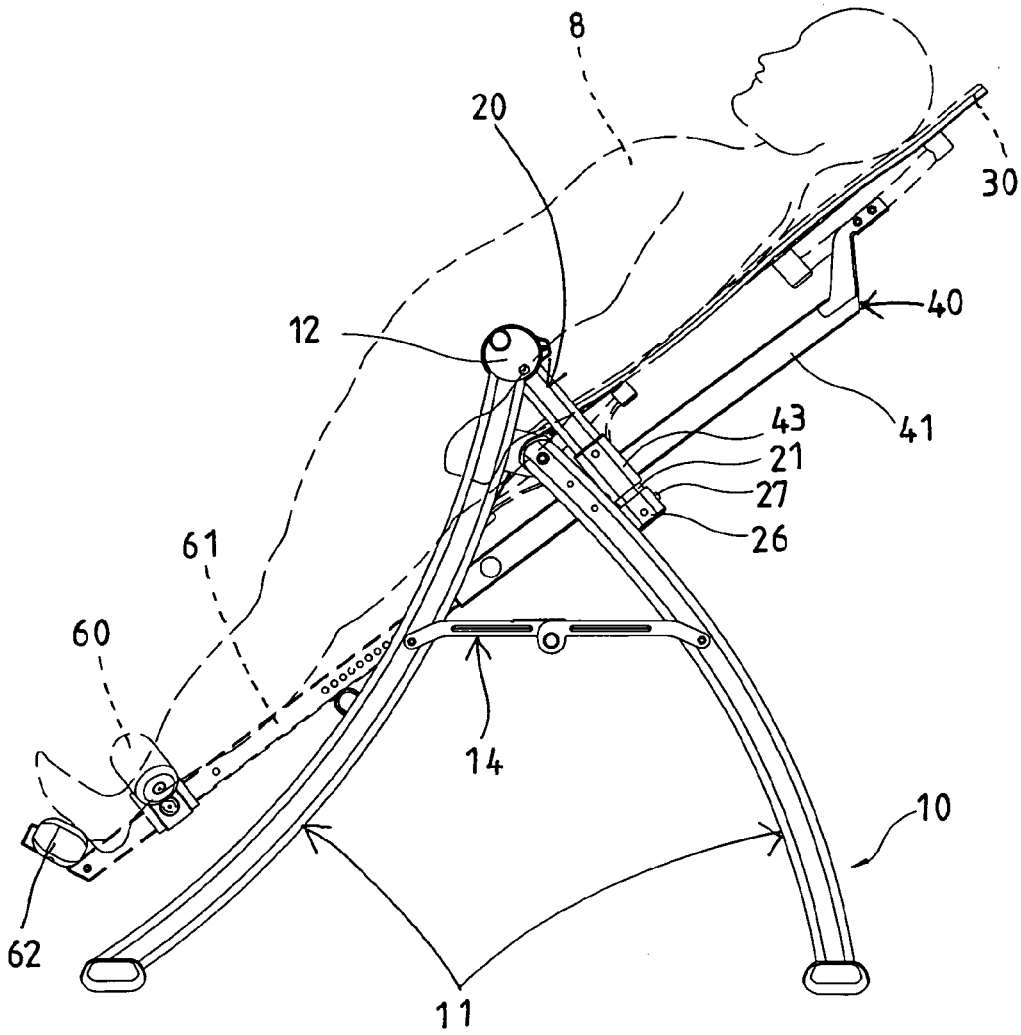
FIG. 5 is a side plan schematic view similar to FIG. 4 illustrating the operation of the tilting inversion exerciser.

The lower supporting stand 10 includes one or more, such as two foldable coupler 14 coupled between the stand members 11 for allowing the stand members 11 of the supporting stand 10 to be folded to a compact folding structure when the foldable coupler 14 is folded, and for allowing the stand members 11 of the supporting stand 10 to be stably supported on a working position when the foldable coupler 14 is opened or unfolded to an open position as shown in FIGS. 1, 4-5. The lower supporting stand 10 may further include a motor driving means or motor and/or a reduction gearing (not shown) disposed or attached or secured to the upper ends or the apex members 12 of the lower supporting stand 10 for driving or rotating the user supporting table 30.

A U-shaped bracket or carrier 20 includes two arms 21 each having one end or upper or first end 22 attached to the pivot axle 13 for allowing the carrier 20 to be rotated relative to the lower supporting stand 10, and a beam or bar 23 attached or secured to the other ends or lower or second ends 24 of the arms 21 for forming a space 25 between the arms 21 and/or the bar 23 (FIG. 2) and for slidably receiving the user supporting table 30. The carrier 20 may further include one or more (such as two) tubular members 26 attached or secured to the ends of the bar 23, or extended or formed on the bar 23 for slidably receiving the arms 21 and for securing to the arms 21 with latches or fasteners 27, and the arms 21 may further include one or more orifices 28 formed in or formed along each of the arms 21. A cap 29 may be attached or secured to the ends of the arms 21 for blocking or closing or sealing the ends of the arms 21.

Figure 3:
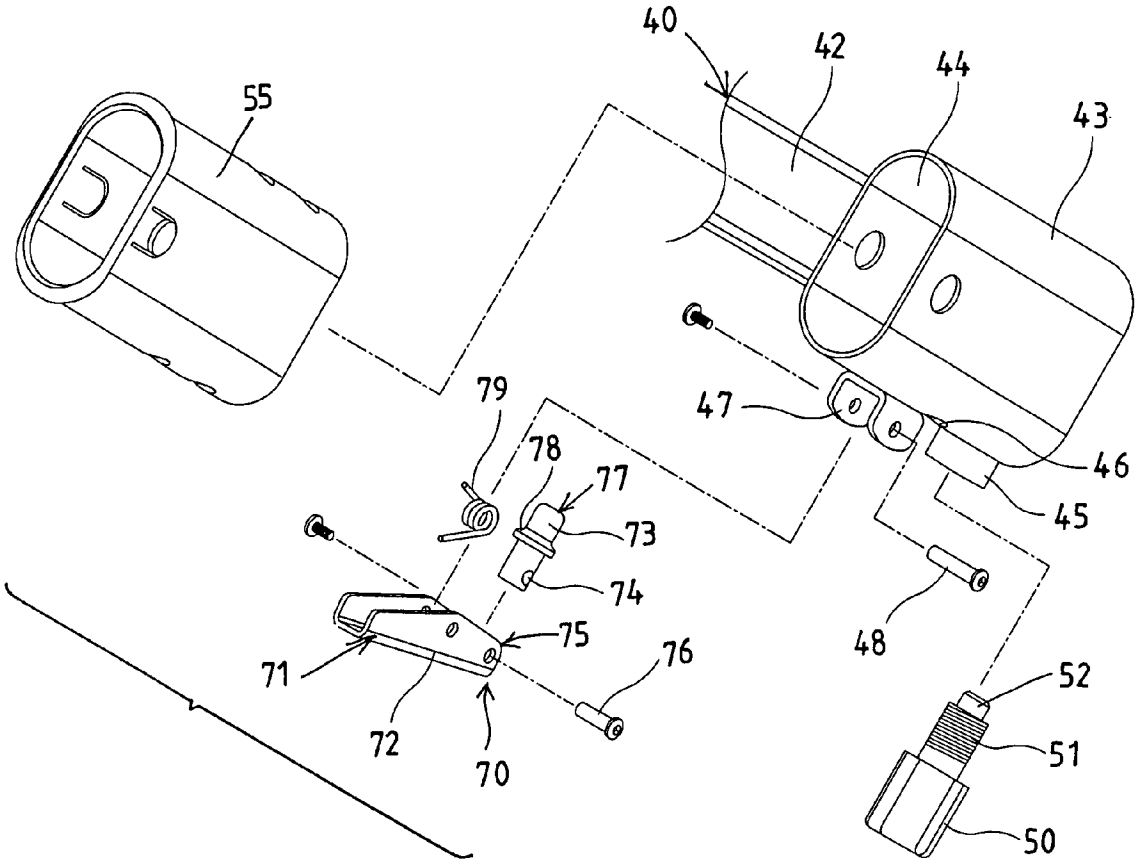
FIG. 3 is another partial exploded view of the tilting inversion exerciser.

A frame 40 includes a longitudinal beam 41 and a lateral beam or rod 42 secured together to attach or secure or support the user supporting table 30 on the frame 40, and includes two sleeve 43 extended or formed on the two ends of the rod 42, and the sleeves 43 each include a bore 44 formed therein (FIGS. 2, 3) for slidably or adjustably receiving or engaging with the arms 21 and for adjustably securing the rod 42 of the frame 40 to the arms 21, and each include a hub 45 formed or provided therein for threading or engaging with the threaded segment 51 of a fastener 50, in which the fastener 50 includes an anchoring end 52 provided on the free end portion thereof for engaging with either of the orifices 28 of the arms 21 and for adjustably securing the rod 42 of the frame 40 to the arms 21 of the carrier 20.

The user supporting table 30 or the frame 40 further includes an ankle holder 60 (FIGS. 1, 4-5) adjustably or coupled to the lower portion of the user supporting table 30 or the frame 40, such as the longitudinal beam 41 of the frame 40 with an adjustable extension 61, for detachably securing the ankle portions of the user 8 to the table 30 and for adjustably supporting the users of different lengths or heights, and a foot pedal 62 attached to the ankle holder 60 or the adjustable extension 61 for being stepped by the users 8 and for stably supporting the user 8 on the user supporting table 30. The ankle holder 60 may be operated with various kinds of motorized actuating devices (not shown) which are typical and will not be described in further details.

The sleeves 43 each further include an aperture 46 formed therein (FIGS. 3 and 6-11) for selectively aligning with either of the orifices 28 of the arms 21, and a U-shaped bracket 47 attached onto the sleeve 43 and disposed or attached or located close to the aperture 46 of the sleeve 43 for attaching or supporting a pivot axle 48. The tilting inversion exerciser further includes a locking or latching device 70 for adjustably locking or securing the frame 40 or the user supporting table 30 to the carrier 20 and for allowing the frame 40 or the user supporting table 30 to be easily and quickly and stably adjusted relative to the carrier 20 and the lower supporting stand 10.

As shown in FIGS. 2-3 and 6-11, the latching device 70 includes a lever 71 having a middle portion 72 pivotally or rotatably attached to the bracket 47 of each sleeve 43 with the pivot axle 48 for allowing the lever 71 to be pivoted or rotated relative to the bracket 47 of the sleeve 43, and a latch member 73 slidably engaged with the aperture 46 of the sleeve 43 and having one or inner end or first end 74 pivotally or rotatably attached to one of the ends 75 of the lever 71 with a pivot pin 76 and having an actuating end 77 (FIG. 3) engaged into either of the orifices 28 of the arms 21 and for adjustably locking or securing the rod 42 of the frame 40 to the arms 21 of the carrier 20, and thus for allowing the user supporting table 30 to be adjustably and solidly locked or secured to the carrier 20 and the lower supporting stand 10.

Figure 6:
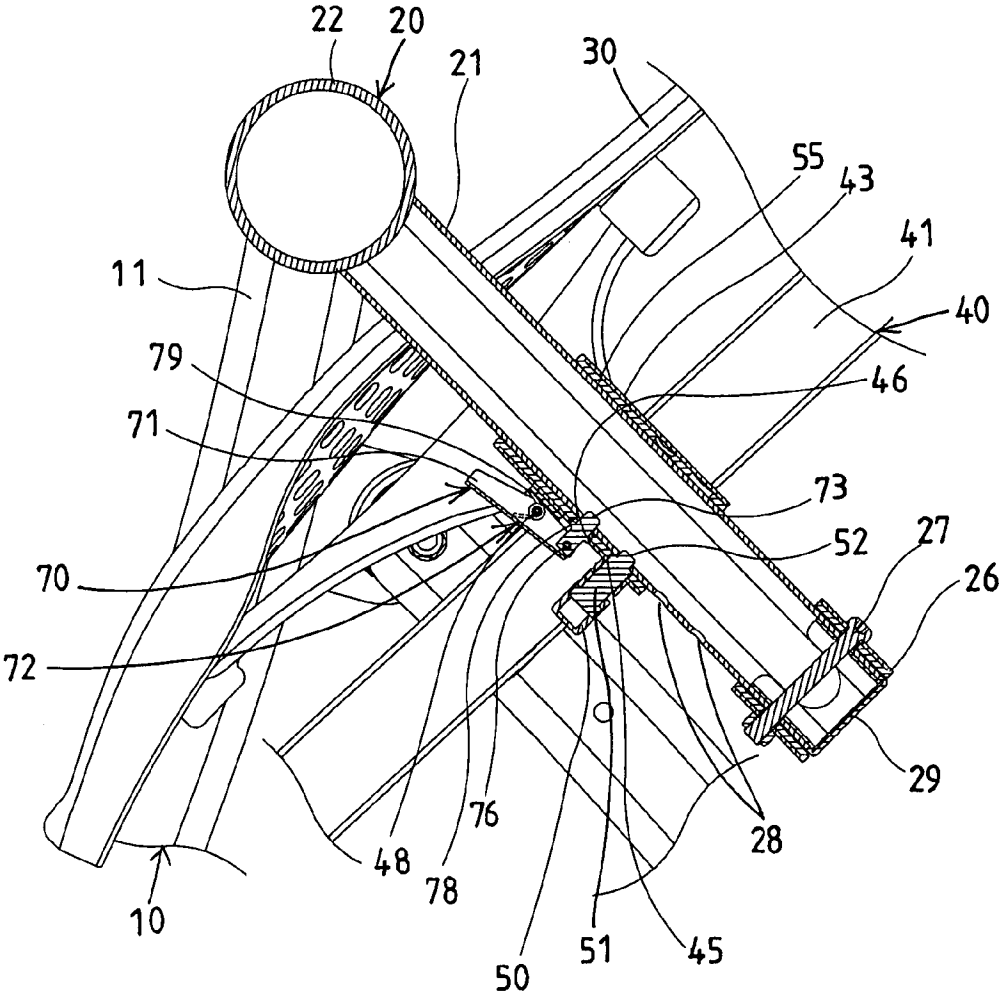
FIG. 6 is an enlarged partial cross sectional view taken along lines 6-6 of FIG. 1.
Figure 7:
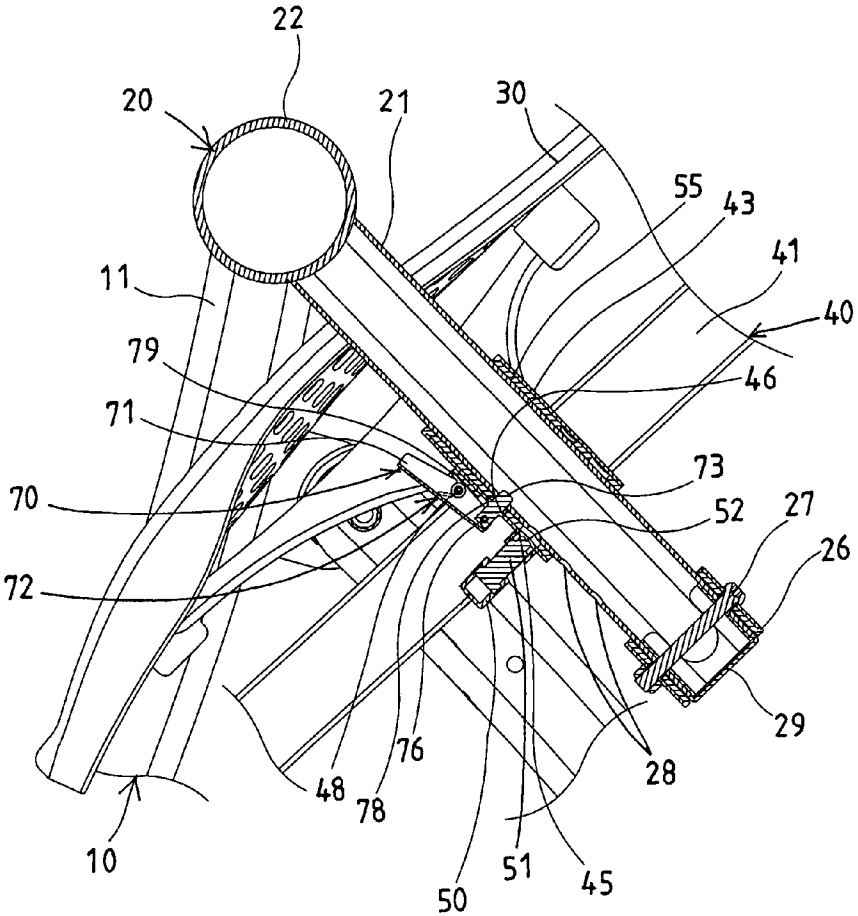
FIGS. 7, 8, 9, 10, 11 are the other partial cross sectional views similar to FIG. 6 illustrating the operation of the tilting inversion exerciser.
Figure 8:
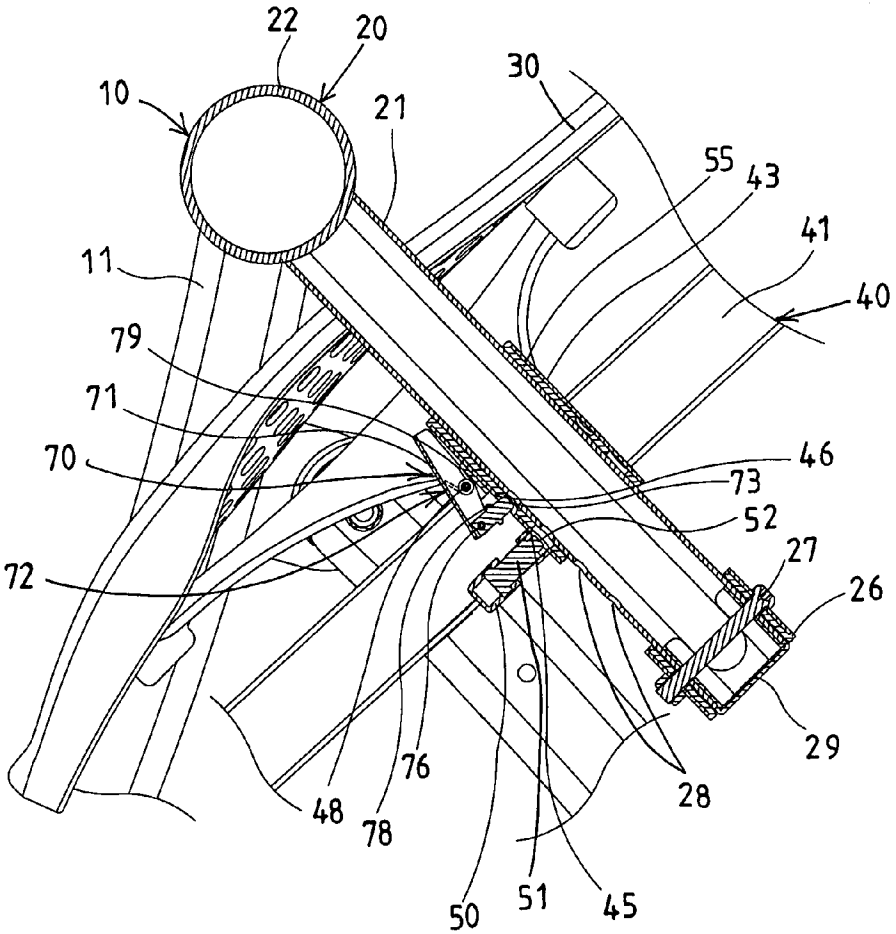
Figure 9:
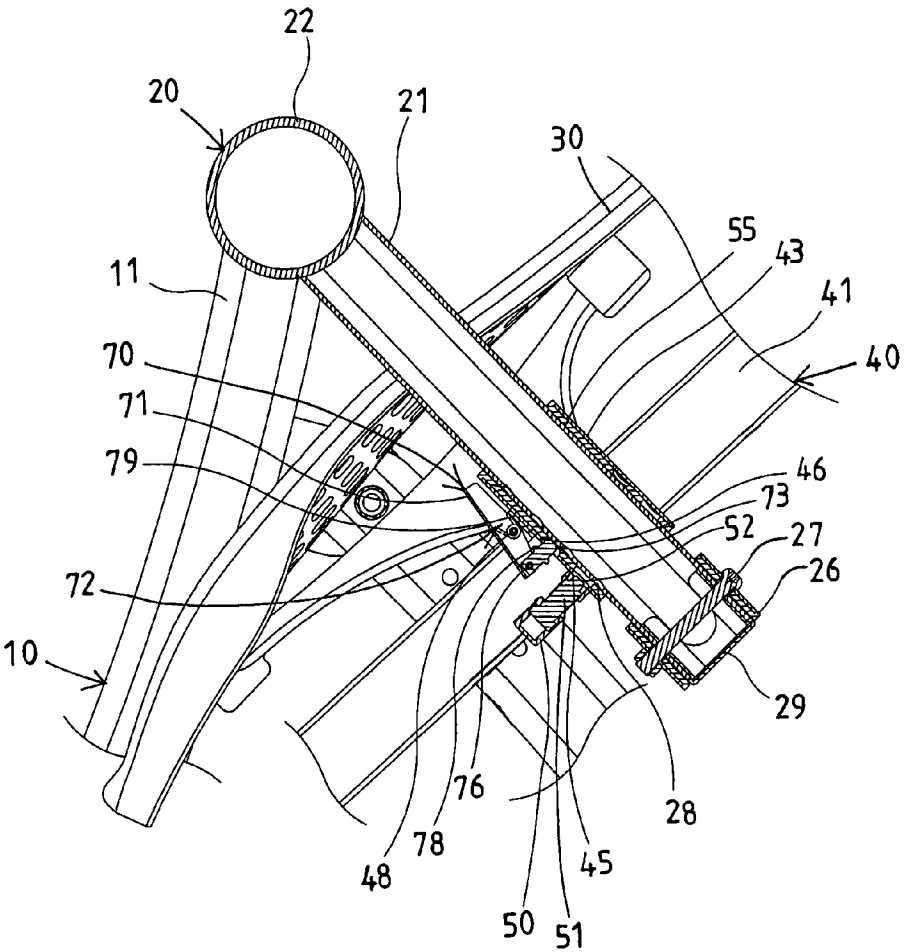

The latch member 73 includes an enlarged peripheral flange or stop 78 extended radially and outwardly therefrom for engaging with the sleeve 43 and for limiting the latch member 73 to slide relative to the sleeve 43 and the carrier 20, and a spring member 79, such as a coil spring member 79 is engaged onto the latch member 73 or the pivot pin 76 and engaged with the sleeve 43 and the lever 71 for biasing or forcing the actuating end 77 of the latch member 73 to engage with either of the orifices 28 of the arms 21 (FIG. 6). A gasket or bushing 55 may further be provided and engaged into each of the sleeves 43 and engaged between the sleeve 43 and the arm 21 for allowing the sleeves 43 to be smoothly slid or moved along the arms 21.

Figure 10:
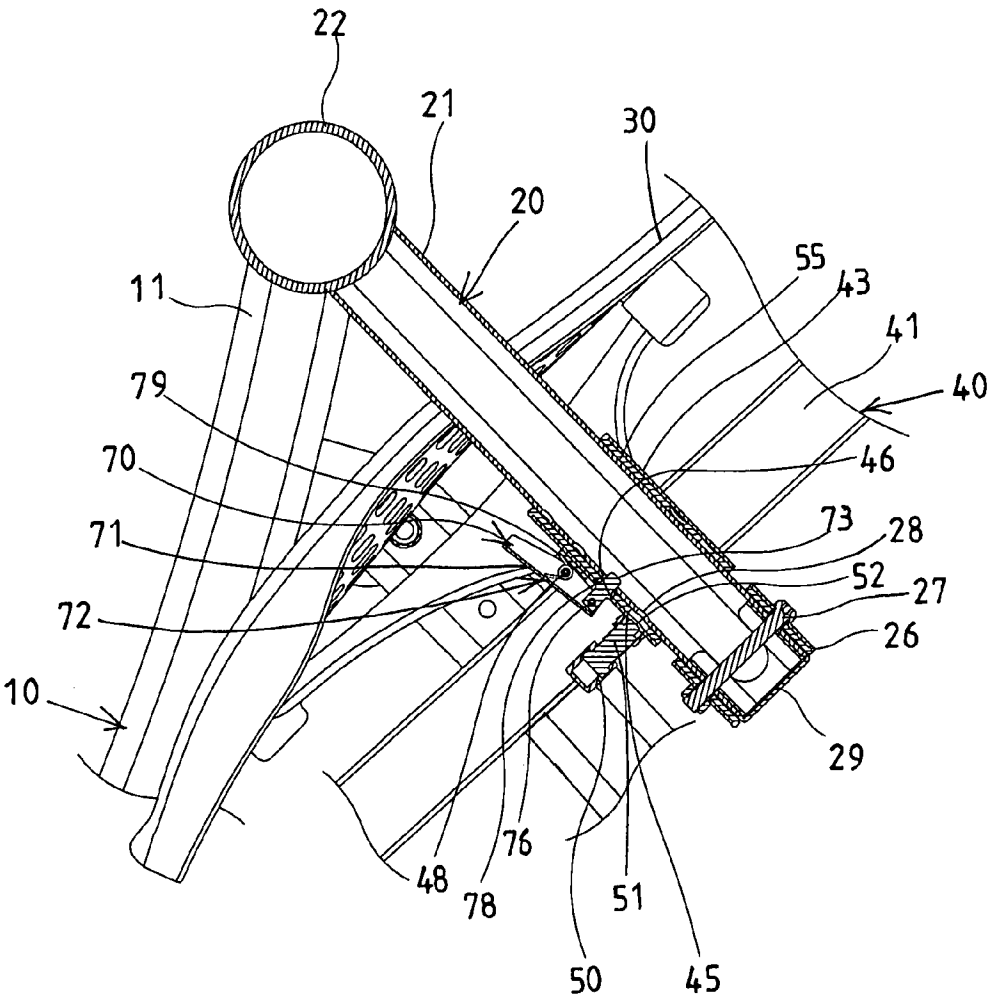
Figure 11:
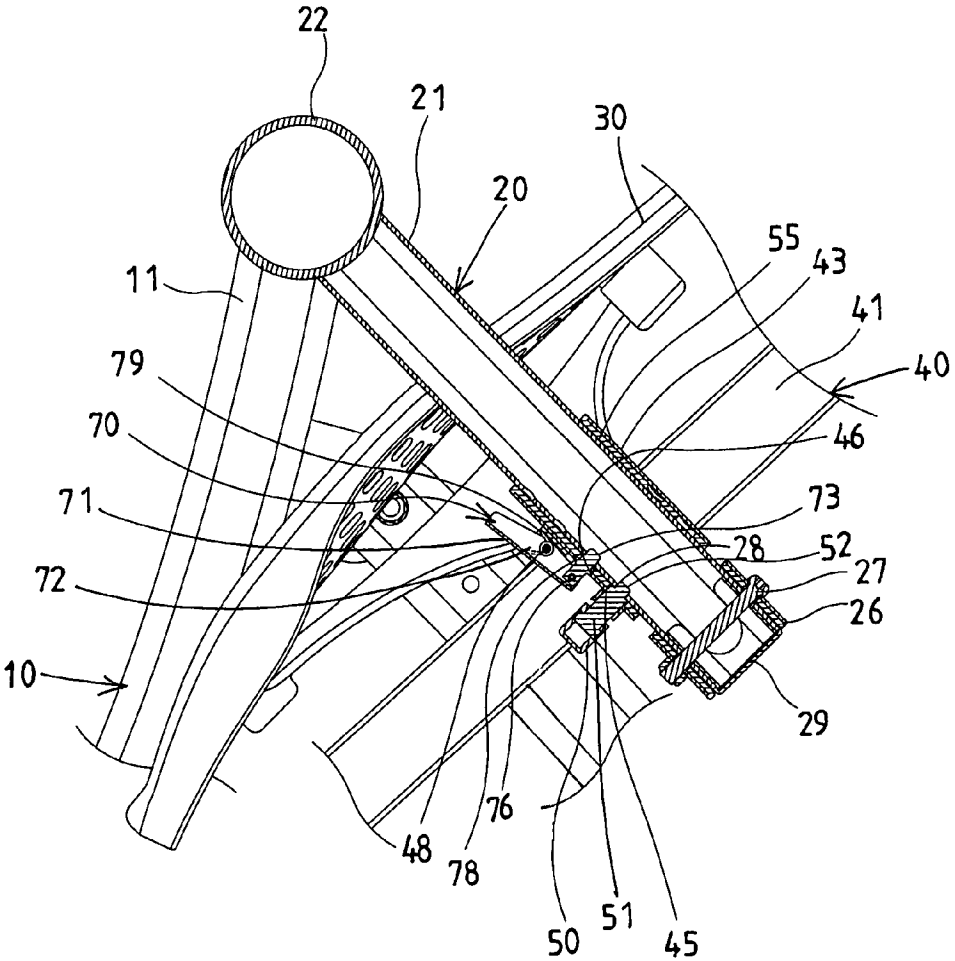

In operation, as shown in FIGS. 7-10, the actuating end 52 of the fastener 50 may be disengaged from the orifices 28 of the arms 21 of the carrier 20 by threading the threaded segment 51 of the fastener 50 relative to the hub 45 of the sleeves 43, and the arms 21 are allowed to be slid or moved relative to the sleeves 43, or relatively, the sleeves 43 are allowed to be slid or moved relative to the arms 21 to the required or suitable position when the actuating end 77 of the latch member 73 is disengaged from the orifices 28 of the arms 21 (FIGS. 8-9) by depressing or actuating the lever 71. The actuating end 77 of the latch member 73 may be biased or forced to engage with either of the orifices 28 of the arms 21 again by the spring member 79 when the lever 71 is released (FIGS. 6, and 10-11).

After the sleeves 43 have been slid or moved or adjusted relative to the arms 21 to the required or suitable or predetermined position or location, and/or after the user supporting table 30 has been moved or adjusted relative to the carrier 20 to the required or predetermined position or location, the lever 71 may be released, and the spring member 79 may bias or force the actuating end 77 of the latch member 73 to engage with either of the orifices 28 of the arms 21 again by the spring biasing force of the spring member 79 and to stably or solidly latching or locking the frame 40 and the user supporting table 30 to the arms 21 of the carrier 20 again and thus for allowing the user supporting table 30 to be easily and quickly and stably adjusted relative to the carrier 20 and the lower supporting stand 10 to the required or suitable or predetermined position or location.

It is to be noted that the user supporting table 30 may be offset and adjusted or moved relative to the pivot axle 13 for allowing the center of gravity of both the user supporting table 30 and the user 8 to be adjusted or located closer to or away from the pivot axle 13 and to be adjusted relative to the center of gravity of the stationary supporting stand 10 and thus for allowing the user supporting table 30 and the user 8 to be suitably rotated and to be stably supported on the stationary supporting stand 10 when the users of different weights or body forms or physiques are supported on the user supporting table 30.

For example, when it is required to support the user of a greater weight or body form or physique on the user supporting table 30, it is preferable that the user supporting table 30 is moved or adjusted toward the bar 23 of the carrier 20 and moved or adjusted away from the pivot axle 13 for allowing both the user supporting table 30 and the user 8 to be located closer to the center of gravity of the supporting stand 10, and thus for allowing both the user supporting table 30 and the user 8 to be stably supported on the supporting stand 10 particularly when the user 8 is conducting the inversion exercises.

On the contrary, when it is required to support the user of a decreased weight or body form or physique on the user supporting table 30, the user supporting table 30 may be moved or adjusted away from the bar 23 of the carrier 20 and moved or adjusted toward the pivot axle 13 for allowing the user supporting table 30 and the user 8 to be located closer to the pivot axle 13 and thus for allowing the user supporting table 30 and the user 8 to be easily rotated relative to the supporting stand 10. The fastener 50 may be used to adjustably and solidly secure the rod 42 of the frame 40 to the arms 21 of the carrier 20, in addition, the latch member 73 may further be provided and engaged with either of the orifices 28 of the arms 21 for further adjustably and solidly locking or securing the rod 42 of the frame 40 to the arms 21 of the carrier 20, and thus for allowing the user supporting table 30 to be adjustably and solidly locked or secured to the carrier 20 and the lower supporting stand 10 with both the fastener 50 and the latch member 73. The sliding engagement of the sleeves 43 onto the arms 21 may stably and adjustably attach and secure the rod 42 of the frame 40 to the arms 21 and may prevent the rod 42 of the frame 40 from being tilted or inclined relative to the arms 21 of the carrier 20.

Accordingly, the tilting inversion exerciser in accordance with the present invention includes a user supporting table pivotally or rotatably attached to a supporting stand with a pivot axle and movable or adjustable relative to the pivot axle of the supporting stand for suitably or adjustably supporting the users of different weights or body forms or physiques.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tilting inversion exerciser comprising: a supporting stand including two apex members, a carrier including two arms each having a first end pivotally attached to said apex member and each having a second end, and a bar attached to said second ends of said arms for forming a space between said arms and said bar, a frame slidably received in said space of said carrier and including a rod adjustably secured to said arms of said carrier for adjusting said frame toward and away from said bar of said carrier, a user supporting table attached to said frame for supporting a user thereon, and a latching device releasably securing said rod of said frame to said arms of said carrier for adjustably securing said user supporting table to said carrier and for adjusting a center of gravity of said user supporting table relative to said carrier and said supporting stand wherein said frame includes two sleeves attached to two ends of said rod, and said sleeves each include a bore formed therein for slidably and adjustably receiving and engaging with said arms and for adjustably securing said rod of said frame to said arms of said carrier, wherein two bushings are engaged into said sleeves and engaged between said sleeves and said arms respectively, wherein said arms each include a plurality of orifices formed therein, and two latch members are slidably attached to said sleeves respectively and each include an actuating end for engaging with either of said orifices of said arms and for adjustably securing said rod of said frame to said arms of said carrier, at least two levers are pivotally attached to said sleeves and at least two spring members are engaged with said sleeves.

2. The tilting inversion exerciser as claimed in claim 1, wherein said latching device includes a fastener attached to each sleeve for engaging with said arms and for adjustably securing said sleeves of said frame to said arms.

3. The tilting inversion exerciser as claimed in claim 2, wherein said arms each include a plurality of orifices formed therein, and said fastener includes an anchoring end for engaging with either of said orifices of said arms and for adjustably securing said rod of said frame to said arms of said carrier.

4. The tilting inversion exerciser as claimed in claim 1, wherein two levers are pivotally attached to said sleeves respectively and each include an end pivotally coupled to said latch member.

5. The tilting inversion exerciser as claimed in claim 4, wherein two spring members are engaged with said sleeves and said levers respectively for biasing and forcing said actuating end of said latch member to engage with either of said orifices of said arms.

6. The tilting inversion exerciser as claimed in claim 4, wherein said levers each include a middle portion pivotally attached to said sleeve with a pivot axle.

7. The tilting inversion exerciser as claimed in claim 1, wherein said latch members each include a peripheral stop for engaging with said sleeve and for limiting said latch member to slide relative to said sleeve and said carrier.

8. The tilting inversion exerciser as claimed in claim 1, wherein said carrier includes two tubular members attached to two ends of said bar for slidably receiving said arms and for securing to said arms with at least one fastener.

* * * * *